US008579593B2

(12) United States Patent
Campbell et al.

(10) Patent No.: US 8,579,593 B2
(45) Date of Patent: Nov. 12, 2013

(54) DAMPING ELEMENT FOR REDUCING THE VIBRATION OF AN AIRFOIL

(75) Inventors: Christian X. Campbell, Oviedo, FL (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 983 days.

(21) Appl. No.: 12/613,957

(22) Filed: Nov. 6, 2009

(65) Prior Publication Data

US 2011/0110762 A1 May 12, 2011

(51) Int. Cl.
*F01D 5/14* (2006.01)
*F01D 5/16* (2006.01)
*F01D 5/18* (2006.01)

(52) U.S. Cl.
USPC ..... 416/229 A; 416/242; 416/500

(58) Field of Classification Search
USPC ..... 416/232, 233, 241 B, 500, 229 A, 229 R
See application file for complete search history.

(56) References Cited

U.S. PATENT DOCUMENTS

| | | | | |
|---|---|---|---|---|
| 3,966,357 | A * | 6/1976 | Corsmeier | 416/97 R |
| 5,056,783 | A | 10/1991 | Mercer et al. | |
| 5,284,011 | A * | 2/1994 | Von Benken | 60/796 |
| 5,384,959 | A | 1/1995 | Velicki | |
| 5,401,138 | A * | 3/1995 | Mosiewicz | 416/226 |
| 5,820,343 | A * | 10/1998 | Kraft et al. | 416/96 A |
| 6,524,074 | B2 | 2/2003 | Farrar et al. | |
| 7,128,536 | B2 | 10/2006 | Williams et al. | |
| 2005/0265843 | A1 * | 12/2005 | Propheter et al. | 416/97 R |
| 2010/0221113 | A1 * | 9/2010 | Cairo | 416/193 A |

* cited by examiner

*Primary Examiner* — Edward Look
*Assistant Examiner* — Jesse Prager

(57) ABSTRACT

An airfoil (10) is provided with a tip (12) having an opening (14) to a center channel (24). A damping element (16) is inserted within the opening of the center channel, to reduce an induced vibration of the airfoil. The mass of the damping element, a spring constant of the damping element within the center channel, and/or a mounting location (58) of the damping element within the center channel may be adjustably varied, to shift a resonance frequency of the airfoil outside a natural operating frequency of the airfoil.

12 Claims, 3 Drawing Sheets

DAMPING ELEMENT FOR REDUCING THE VIBRATION OF AN AIRFOIL

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates to airfoils, and more specifically, to a damping element used to reduce the vibration of an airfoil.

BACKGROUND OF THE INVENTION

Turbine blades commonly encounter induced vibration during typical operation. A number of conventional methods have been proposed to reduce this induced vibration. For example, a tip shroud has been used to reduce induced vibration in medium sized blades, but in large sized blades, such a tip shroud introduces an undesired centrifugal pull load. In another example, damper pins have been installed to reduce induced vibration in small sized blades, but in large sized blades, these damper pins have proved ineffective.

Thus, it would be advantageous to provide a system to reduce the induced vibration in large sized blades, without the drawbacks introduced by conventional methods.

BRIEF DESCRIPTION OF THE DRAWINGS

The invention is explained in the following description in view of the drawings that show.

DETAILED DESCRIPTION OF THE INVENTION

In order to address the shortcomings of the conventional methods for reducing induced vibration in larger airfoils addressed above, the present inventors have developed an improved design, in which a damping element is inserted and secured within a channel of the airfoil near the tip of the airfoil. The damping element is selectively sized and manufactured such that it absorbs induced vibration adjacent to the tip of the airfoil, and is selectively positioned such that it coincides with a predetermined area of large vibration during typical operation of the airfoil. Hence, the induced vibration experienced by the airfoil is significantly absorbed by the damping element and thus reduced. Although some embodiments of the present invention discuss an airfoil used within a gas turbine engine, the present invention is not limited to airfoils used within gas turbines, and may be applied to any airfoil used in any aerodynamic application during which stress/force is imposed on the airfoil. Additionally, although some embodiments of the present invention discuss an airfoil of large size, the present invention is not limited to airfoils of any particular size and may be applied to any airfoil having any size.

Figure 1:
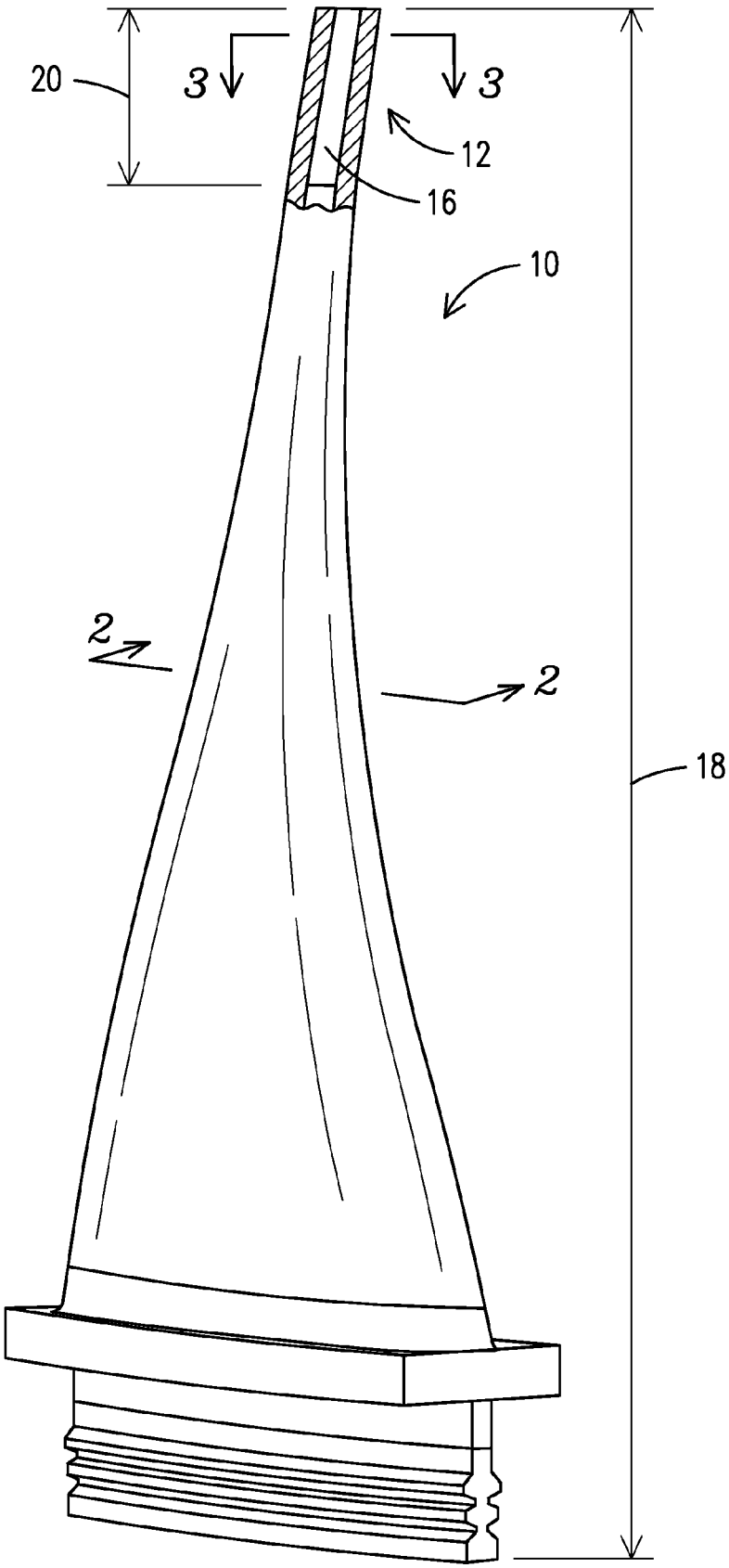
FIG. 1 is a side perspective view of an airfoil with a partial cross-sectional view of an exemplary embodiment of a damping element positioned within the tip to reduce an induced vibration of the airfoil.
Figure 2:
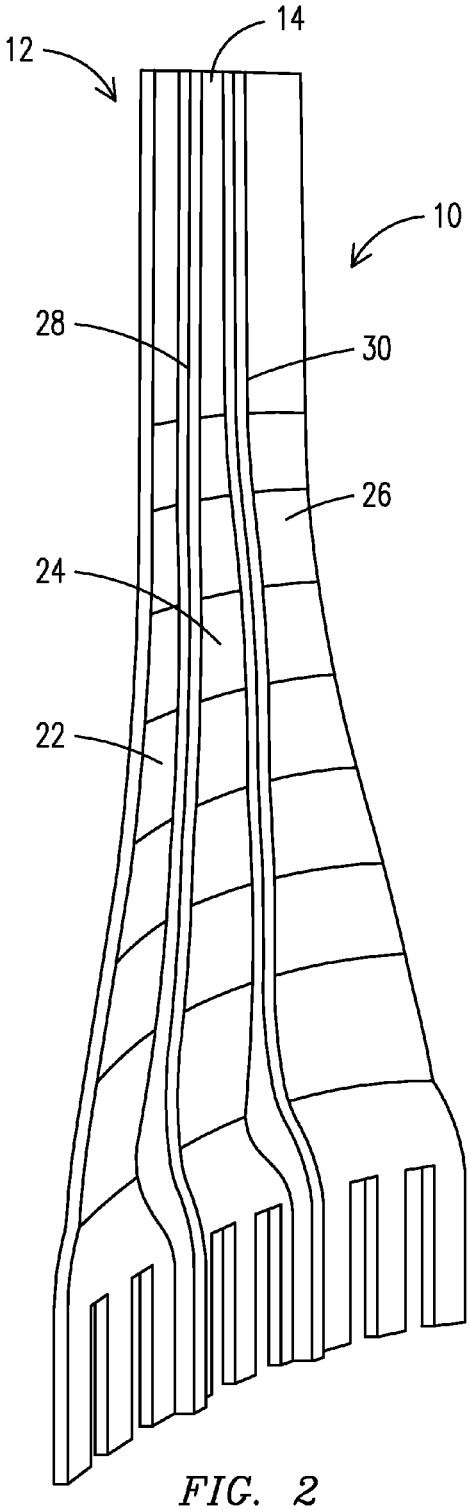
FIG. 2 is a cross-sectional side view of the airfoil in FIG. 1 taken along section 2-2.

FIG. 1 illustrates an airfoil 10, which may be a large size airfoil, such as a row 4 blade, for example. The airfoil 10 includes a tip 12 or an outer airfoil shape in which an opening 14 (FIG. 2) is formed to an interior channel, such as a center channel 24. As illustrated in FIG. 2, the center channel 24 is one of three cooling channels 22, 24, 26 formed in the airfoil 10, which each facilitate a flow of cooling fluid through the airfoil 10. As further illustrated in FIG. 1, a damping element 16 is inserted within the opening 14 of the center channel 24, to reduce a vibration of the airfoil 10 induced during a typical operation of the airfoil 10. The damping element 16 may be formed from a ceramic matrix composite (CMC) material, for example. The CMC material may be selected to form the damping element 16, based on damping characteristics of the CMC material, such as a high damping coefficient as determined by a ratio of incident energy that is absorbed by the material, and a relatively low ratio of mass per unit of absorbed energy. Additionally, the CMC material exhibits advantageous thermal properties, such as a high melting point in excess of the operating temperature range of the airfoil environment. Although FIGS. 1-2 illustrate an airfoil having three cooling channels and a damping element inserted within the center channel, the embodiments of the present invention are not limited to this exemplary embodiment, and may include an airfoil having less or more than three cooling channels and/or inserting the damping element into any of the cooling channels.

Upon inserting the damping element 16 into the center channel 24, cooling fluid is at least partially blocked from passing through a length 20 of the center channel 24 adjacent to the tip 12 of the airfoil 10. The form of the damping element 16, which affects the degree of blockage of cooling fluid through the center channel 24, will be discussed in greater detail below. The airfoil 10 includes a pair of ribs 28, 30 which are aligned along a respective side 32, 34 of an inner surface of the center channel 24, and define the center channel 24. In order to alleviate the partial blockage of cooling fluid through the center channel 24, apertures may be formed in an outer surface of the airfoil 10, adjacent to the tip 12, such that the cooling fluid passing through the center channel 24 is permitted to flow out from the center channel 24 through the apertures. Alternatively (or in addition), apertures 40 (FIG. 6) may be formed in the ribs 28, 30 adjacent to the tip 12 of the airfoil 10, such that the cooling fluid is permitted to flow out from the center channel 24, through the apertures 40, and into an adjacent channel 22,26. However, neither of the apertures may be needed in the airfoil 10, particularly if the degree of blockage of cooling fluid through the center channel 24 caused by the damping element 16 is not sufficiently great.

Prior to inserting the damping element 16 into the center channel 24, a vibration pattern of the airfoil 10 during a typical operation is determined. Such a predetermined vibration pattern may be obtained from any number of diagnostic or modeling systems, as appreciated by one of skill in the art. This predetermined vibration pattern includes data of a number of maximum defection points of high deflection over a length of the airfoil 10. In an exemplary embodiment of the invention, the damping element 16 is inserted within the opening 14 over the length 20 of the center channel 24 which corresponds with one or more of these maximum deflection points, in order to maximize the damping effect of the induced vibration of the airfoil 10 during operation.

Figure 5:
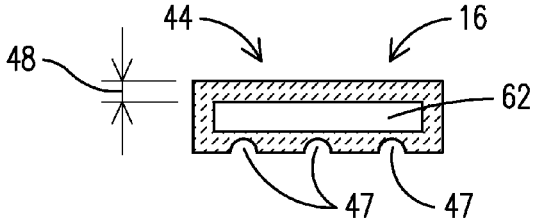
FIG. 5 is an isolated top view of the damping element illustrated in FIG. 1.
Figure 4:
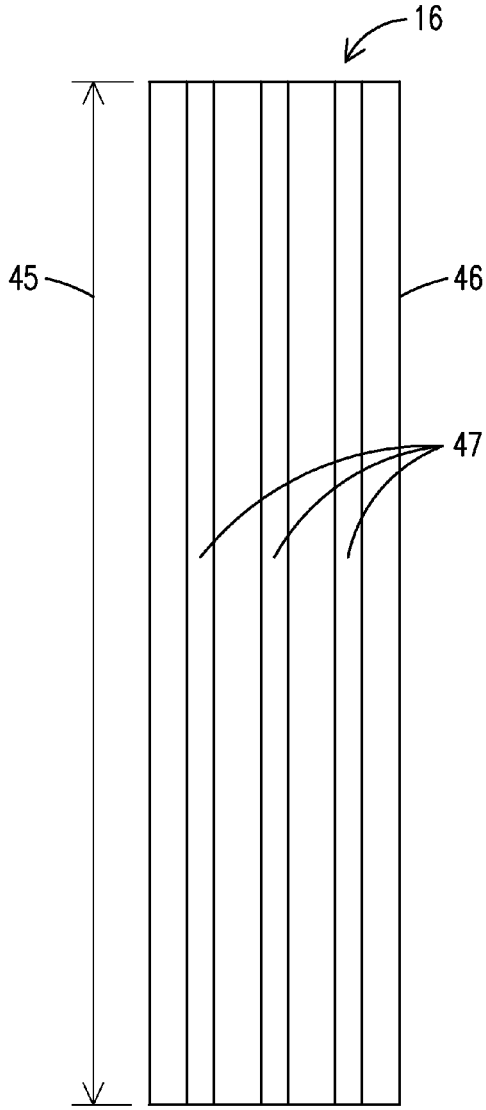
FIG. 4 is an isolated side view of the damping element illustrated in FIG. 1.

As discussed above, the damping element 16 is inserted through the opening 14 over the length 20 of the center channel 24 adjacent to the tip 12. As illustrated in FIG. 1, this length 20 of the center channel 24 over which the damping element 16 is inserted and secured has a substantially constant cross-section 42. In an exemplary embodiment, where the airfoil 10 is the row 4 blade, the substantially constant cross-section may have dimensions of approximately 7 mm×24 mm, for example. Additionally, as illustrated in FIG. 5, the damping element 16 may have a substantially constant cross-section 44 along its length 45. The substantially constant cross-section 44 of the damping element 16 is based on the substantially constant-cross section 42 along the length 20 of the center channel 24 adjacent to the tip 12. More specifically, as illustrated in FIGS. 4-5, the damping element 16 takes the form of a rectangular tube 46 having a cross-section 44 being substantially equal to the cross-section 42 along the length 20 of the center channel 24 adjacent to the tip 12. In an alternative embodiment, the cross-sections 42,44 take the form of rectangular cross-sections having a respective length dimension and a respective width dimension, and in an exemplary embodiment of the present invention, a thickness 48 of the rectangular tube 46 may be selectively adjusted to reduce the induced vibration. Additionally, the thickness 48 of the rectangular tube 46 may be selectively adjusted to vary the degree of blockage of cooling fluid through the center channel 24. For example, in order to minimize the blockage of cooling fluid through the center channel 24, the thickness 48 would be minimized while still achieving a desired reduction in induced vibration of the airfoil 10. Based on the thickness 48 of the rectangular tube 46, the degree of blockage of cooling fluid through the center channel 24 may be determined, which in-turn may determine the need for the apertures 40 discussed above, to compensate for the blockage. Thus, in a design phase of the damping element 16, the thickness 48 may be varied, to adjust the dimensions of an opening through the rectangular tube 46, which in-turn adjusts the flow of an amount of cooling fluid which passes through the damping element 16, to cool the airfoil 10 during operation. In an exemplary embodiment, during operation, the cooling fluid may pass up through the center channel 24 to a base of the damping element 16, and the flow of the cooling fluid may be reduced, based on the thickness 48 of the rectangular tube 46. A portion of the cooling fluid may be diverted through the apertures 40 in the ribs 28,30, and into one or more of the adjacent channels 22,26, thereby enhancing the flow of cooling fluid through the channels 22,24,26 of the airfoil 10. Additionally, a portion of the cooling fluid within the center channel 24 and/or a portion of the cooling fluid within the adjacent channels 22,26 may be diverted through the apertures formed in the outer surface of the airfoil 10, to pass the cooling fluid over the outer surface of the airfoil 10, and thus cool the outer surface of the airfoil 10 during operation.

In certain embodiments, an outside surface of the damping element 16 may be formed with depressions 47 that function as cooling passages to allow some cooling fluid to pass along the outside surface of the damping element 16 to promote cooling of the airfoil skin. The dimensions and/or the spacing of the depressions 47 may be adjusted, such that the damping element 16 provides an adequate degree of damping of the induced vibration of the airfoil 10, while simultaneously enhancing the cooling of the airfoil skin. Although FIG. 5 illustrates three depressions 47 formed along the outside surface of the damping element 16, more or less than three depressions may be formed.

Figure 3:
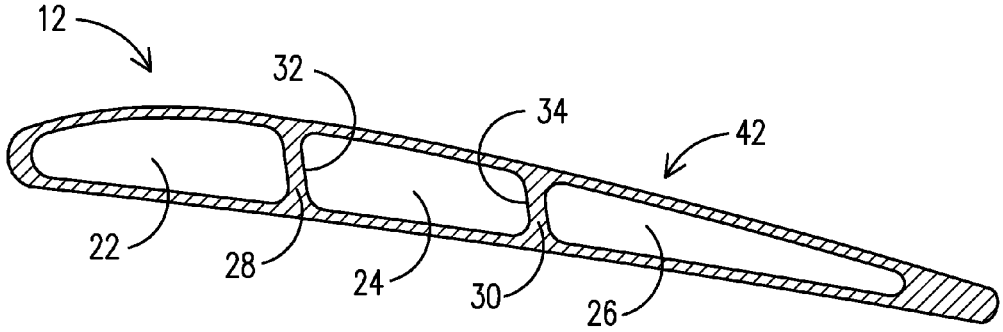
FIG. 3 is a cross-sectional top view of a tip of the airfoil in FIG. 1 with the damping element removed, taken along section 3-3.
Figure 6:
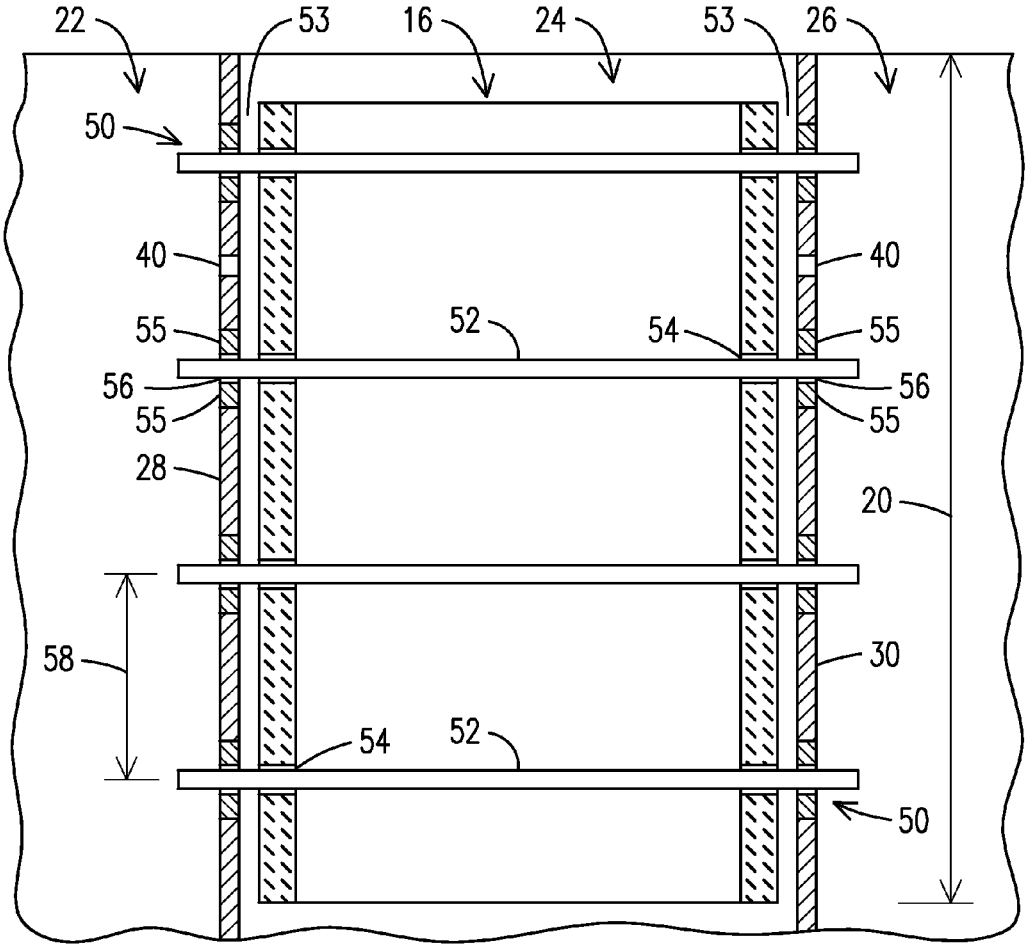
FIG. 6 is a cross-sectional view of the damping element secured within the airfoil.

As illustrated in FIG. 6, in order to secure the damping element 16 within the center channel 24 during operation of the airfoil 10, a locking device 50 is positioned on the inner surface of the center channel 24 adjacent to the tip 12. More specifically, the locking device 50 may include pins 52 which pass through a respective hole 54 along a width of the damping element 16 and the center channel 24, and are secured within a hole 56 formed in the ribs 28, 30 aligned along the respective sides 32, 34 of the inner surface of the center channel 24. As illustrated in FIG. 6, the holes 56 are formed in the ribs 28, 30 at respective heights 58 along the length 20 of the center channel 24 adjacent to the tip 12, to securely receive the pins 52 which have passed through the holes 54 through the width of the damping element 16. Although FIG. 6 illustrates that the locking device includes pins which pass through a respective hole in the damping element and are secured within a respective hole in the ribs at a respective height, one pin may be used, or an alternate structure may be used other than pins to rigidly secure the damping element within the length of the center channel adjacent to the tip. In certain embodiments, cooling fluid passes through a gap 53 between the damping element 16 and the ribs 28,30, after the damping element 16 has been secured within the center channel 24 with the locking device 50. In an alternative embodiment, the center channel 24 and/or the damping element 16 may be sized such that a gap similar to the gap 53 of FIG. 6 is formed between the damping element 16 and the inner surface of the airfoil skin, while the gap 53 may be substantially closed. In such an embodiment, the damping element 16 may be inserted within the center channel 24 such that the depressions 47 (FIG. 5) are aligned within the gap along the inner surface of the airfoil skin, to enhance the passage of cooling fluid along the airfoil skin. Additionally, the damping element 16 is securely held within the center channel 24 based on a closure of the gap 53 between the damping element 16 and the ribs 28,30. For example, such an embodiment may involve sizing the rectangular cross-section 44 of the damping element 16 (FIG. 5) and the rectangular cross-section 42 of the center channel 24 (FIG. 3), such that the shorter dimension of the rectangular cross-section 44 is smaller than the shorter dimension of the rectangular cross-section 42, while the longer dimension of the rectangular cross-section 44 is substantially equal to the longer dimension of the rectangular cross-section 42. The rectangular cross-sections 42,44 may have respective length dimensions and width dimensions, and one or more of the respective length and width dimensions of the rectangular cross-section 44 of the damping element 16 may be smaller than the respective length and width dimensions of the rectangular cross-section 42 of the center channel 24. In the event that both of the respective length and width dimensions of the rectangular cross-section 44 are smaller than the respective length and width dimensions of the rectangular cross-section 42, the locking device 50 may be utilized to ensure that the damping element 16 is secured within the center channel 24. In an alternative embodiment, the respective length and width dimensions of the rectangular cross-section 44 may be substantially equal to the respective length and width dimensions of the rectangular cross-section 42, and thus the locking device 50 may not be necessary to secure the damping element 16 within the center channel 24.

In an alternate embodiment, an elastic material 55 (FIG. 6) surrounds the hole 56 at each respective height 58 location, where the elastic material has a respective spring constant, to selectively vary a vibratory response of the damping element 16 during an operation of the airfoil 10. Additionally, the thickness 48 of the rectangular tube 46 may be adjustably varied, to vary the mass of the damping element 16. Prior to inserting the damping element 16 within the center channel 24, a resonance frequency, or an operating frequency resulting in maximum vibratory response of the airfoil 10, is determined during a typical operation. In the event that such a resonance frequency coincides with a natural operating frequency of the airfoil 10, the alternate embodiment of the present invention shifts the resonance frequency of the airfoil 10 to one or more subsequent resonance frequencies which lie outside a range of the natural operating frequency, thereby significantly reducing the possibility of a maximum vibratory response of the airfoil 10 during operation. In order to shift the resonance frequency of the airfoil 10 to one or more subsequent resonance frequencies which lie outside the range of the natural operating frequency, an adjustment is made to one or more of: (1) the mass of the damping element 16 (by varying the thickness 48), (2) the number or position of the respective height 58 locations along the center channel 24, and/or (3) the elastic material 55, thereby varying the spring constant surrounding the hole 56 through which the pin 52 is passed. Such an adjustment may be performed by a computer program designed to shift a resonance frequency of an object to a subsequent resonance frequency that lies outside a natural operating frequency range of that object, as appreciated by one of skill in the art. By applying such a computer program to the adjustable variables above, the resonance frequency of the airfoil 10 may be shifted to a pair of subsequent resonance frequencies, for example, which lie outside the range of the natural operating frequency of the airfoil 10, thereby minimizing the vibratory response of the airfoil 10. The elastic material 55 may be any spring element having a respective spring constant, such as a coil spring, for example. Although a coil spring may be utilized in the vicinity of the hole 56, and thus the spring constant of the coil spring may be used in performing the calculations discussed below, the embodiments of the present invention are not limited to the use of a coil spring, and include any material having a spring constant or known stiffness, where the spring constant or stiffness can be utilized in computing its effect on the shift of the resonance frequency of the airfoil 10.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An airfoil comprising:

an outer airfoil shape surrounding an interior channel;

a damping element inserted within the interior channel effective to reduce an induced vibration of the airfoil;

wherein said damping element comprises a ceramic matrix composite material; and a locking device configured to secure the damping element within the interior channel during an operation of the airfoil, wherein said locking device comprises at least one pin configured to pass through a hole along a width of the damping element, and through respective holes formed in a pair of ribs defining the interior channel.

2. The airfoil of claim 1, wherein said airfoil includes a predetermined vibration pattern during operation having a plurality of maximum deflection points over a length of the airfoil, wherein said damping element is inserted within the channel over a length which spans at least one maximum deflection point.

3. The airfoil of claim 1, wherein said damping element is to be inserted over a length of the interior channel, said length being adjacent to a tip of the airfoil and having a substantially constant cross-section.

4. The airfoil of claim 1, wherein the locking device further comprises a spring element.

5. The airfoil of claim 4, wherein the spring element comprises a coil spring.

6. The airfoil of claim 4, wherein the spring element comprises an elastic material.

7. The airfoil of claim 1, wherein at least one depression is formed in an exterior surface of the damping element, to enhance a passage of cooling fluid through the interior channel and along an inner surface of the airfoil.

8. The airfoil of claim 7, wherein said damping element is sized such that a gap is formed within the interior channel between the inner surface of the airfoil and the damping element, to enhance the passage of cooling fluid through the interior channel.

9. The airfoil of claim 1, wherein said damping element is a tube having a thickness to define an opening through the tube; and wherein said thickness is adjusted to vary a passage of cooling fluid through the interior channel.

10. The airfoil of claim 1, further comprising a pair of ribs aligned along a respective side of the interior channel, wherein a plurality of apertures are formed in the ribs, such that a passage of cooling fluid from the interior channel is redirected through the apertures into an adjacent channel.

11. The airfoil of claim 1, wherein a plurality of apertures are formed in an outer surface of the airfoil, such that a passage of cooling fluid from the interior channel is redirected through the apertures to exterior of the airfoil.

12. The airfoil of claim 1, wherein the damping element and the interior channel have a respective rectangular cross-section including a respective length dimension and a respective width dimension; and wherein at least one of the respective length and width dimension of the damping element is less than the respective length and width dimension of the interior channel.

* * * * *